US005525895A

United States Patent [19]

Fishman

[11] Patent Number: 5,525,895

[45] Date of Patent: Jun. 11, 1996

[54] POWER SUPPLY FOR PORTABLE TELEPHONE

[75] Inventor: David A Fishman, Lakewood, N.J.

[73] Assignee: AT&T Corp., Murray Hill, N.J.

[21] Appl. No.: 330,048

[22] Filed: Oct. 27, 1994

[51] Int. Cl.[6] ..... G05F 1/40

[52] U.S. Cl. ..... 323/268; 323/269; 323/270; 174/35 R

[58] Field of Search ..... 323/224, 225, 323/226, 266, 268, 269, 270; 174/35 R

[56] References Cited

U.S. PATENT DOCUMENTS

| | | | |
|---|---|---|---|
| 4,881,023 | 11/1989 | Perusse et al. | 323/273 |
| 5,216,351 | 6/1993 | Shimoda | 323/224 |
| 5,216,353 | 6/1993 | Mori | 323/288 |
| 5,414,340 | 5/1995 | Gannon | 323/266 |

*Primary Examiner*—Peter S. Wong

*Assistant Examiner*—Shawn Riley

[57] ABSTRACT

A power supply for a portable telephone, includes a battery pack comprised of at least one battery cell providing an unregulated output voltage; a boost/buck switcher connected with the battery pack for boosting/bucking the output voltage to a different level; a first regulator connected with the boost/buck switcher for regulating the boosted/bucked output voltage to produce a first regulated voltage; a second regulator connected with the boost/buck switcher for regulating the boosted/bucked output voltage to produce a second regulated voltage having a voltage value different from the first regulated voltage; an EMI shielded case surrounding the battery pack, the boost/buck switcher, the first regulator and the second regulator; a first output terminal connected to the battery pack and supplied with the output voltage; a second output terminal connected with the first regulator and supplied with the first regulated voltage from the first regulator; and a second output terminal connected with the second regulator and supplied with the second regulated voltage from the second regulator.

20 Claims, 1 Drawing Sheet

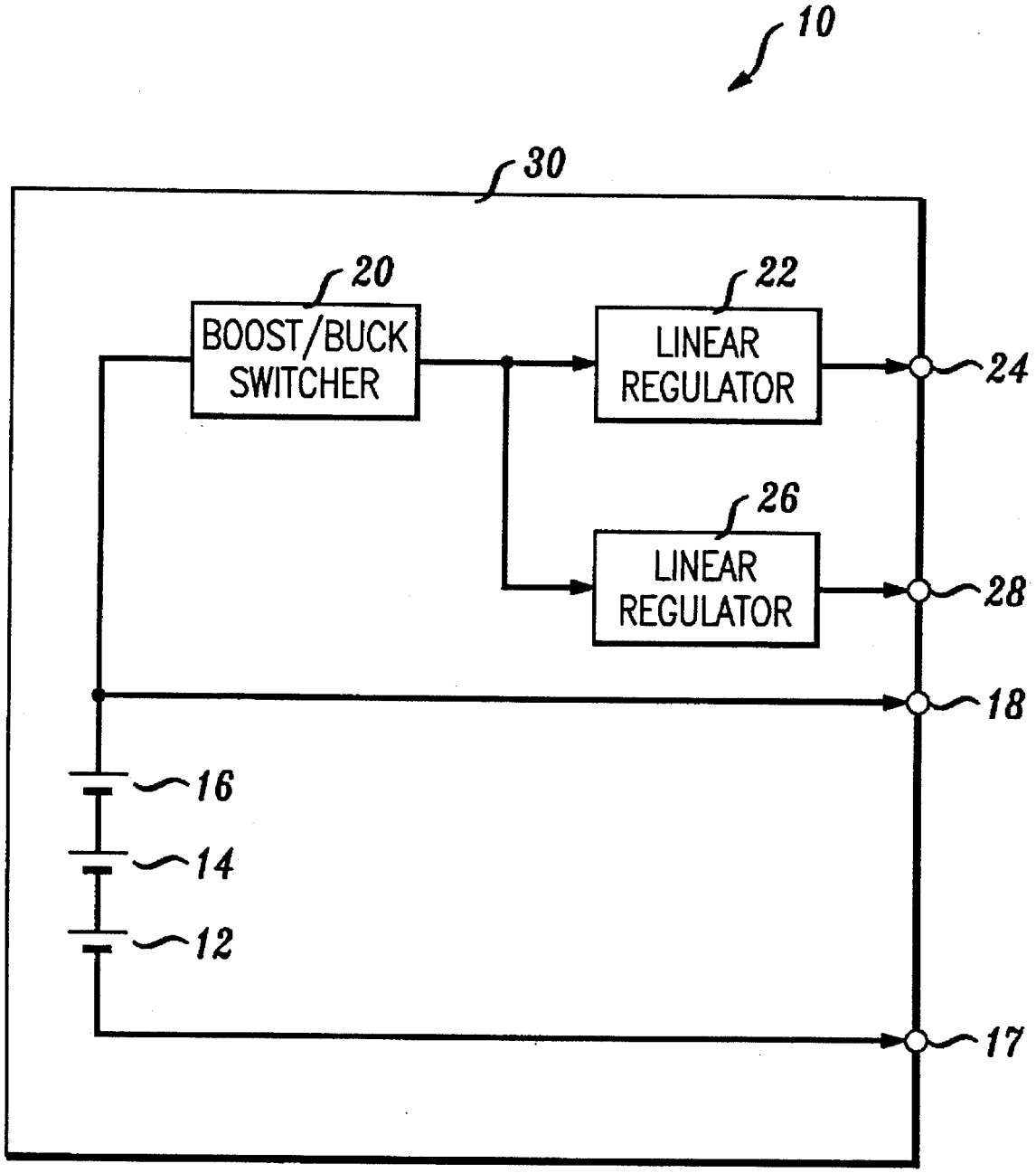
10
30
20
BOOST/BUCK SWITCHER
22
LINEAR REGULATOR
24
26
LINEAR REGULATOR
28
18
16
14
12
17

POWER SUPPLY FOR PORTABLE TELEPHONE

BACKGROUND OF THE INVENTION

The present invention relates generally to power supplies, and more particularly, is directed to a power supply for a portable telephone or other small electronic device.

Conventionally, portable telephones have a power supply consisting of several batteries in series, to provide an unregulated voltage, connected to a voltage regulator. In the case of linear regulation, the voltage produced by the battery cells is greater than that of the regulated output. For most portable phones, this arrangement is accomplished with five batteries in a battery pack, and an external regulator in the telephone. The result is a large, heavy and expensive battery.

Alternatively, a switching power supply can be used to allow an output voltage which is greater than the battery voltage, thereby allowing a reduction in the number of battery cells. A reduction from five cells to even one cell is possible. This approach is rarely used because of radiated and conducted EMI (electro-magnetic interference), and requirements for low-ripple (low noise) on the regulated output.

SUMMARY OF THE INVENTION

Accordingly, it is an object of the present invention to provide a power supply for a portable telephone that overcomes the problems with the aforementioned prior art.

It is another object of the present invention to provide a power supply for a portable telephone that is relatively lightweight.

It is still another object of the present invention to provide a power supply for a portable telephone that has a reduced size in comparison with conventional power supplies.

It is still another object of the present invention to provide a power supply for a portable telephone that is relatively inexpensive to manufacture and use.

It is yet another object of the present invention to provide a power supply for a portable telephone which is packaged within an EMI shielded case.

In accordance with an aspect of the present invention, a power supply for a portable telephone, includes at least one battery cell providing an unregulated output voltage; a boost/buck switcher connected with the at least one battery cell for boosting/bucking the output voltage to a different level; and a regulator connected with the boost/buck switcher for regulating the boosted/bucked output voltage to produce a regulated voltage.

Illustratively, the at least one battery cell includes three the battery cells connected in series, such that the output voltage is an unregulated voltage in the range of approximately 3.0 to 4.2 volts.

An output terminal is connected to the at least one battery cell and supplied as an unregulated output voltage, and an output terminal is connected with the regulator and supplied as a regulated voltage. The unregulated output is optional, and depends on the application.

Further, an EMI shielded case surrounds the at least one battery cell, the boost/buck switcher and the regulator.

In accordance with another aspect of the present invention, a power supply for a portable telephone, includes at least one battery cell providing an unregulated output voltage; a boost/buck switcher connected with the at least one battery cell for boosting/bucking the output voltage to a different level; a first regulator connected with the boost/buck switcher for regulating the boosted/bucked output voltage to produce a first regulated voltage; and a second regulator connected with the boost/buck switcher for regulating the boosted/bucked output voltage to produce a second regulated voltage having a voltage value different from the first regulated voltage.

A first output terminal is connected to the at least one battery cell and supplies an unregulated output voltage. An output terminal is connected with the first regulator and supplies the first regulated voltage, and an output terminal is connected with the second regulator and supplies the second regulated voltage.

In accordance with another aspect of the present invention, a power supply for a portable telephone, includes at least one battery cell providing an output voltage; a boost/buck switcher connected with the at least one battery cell for boosting/bucking the output voltage to a different level; a first regulator connected with the boost/buck switcher for regulating the boosted/bucked output voltage to produce a first regulated voltage; a second regulator connected with the boost/buck switcher for regulating the boosted/bucked output voltage to produce a second regulated voltage having a voltage value different from the first regulated voltage; and an EMI shielded case surrounding the at least one battery cell, the boost/buck switcher, the first regulator and the second regulator.

The above and other objects, features and advantages of the invention will become readily apparent from the following detailed description thereof which is to be read in connection with the accompanying drawings.

BRIEF DESCRIPTION OF THE DRAWING

FIG. 1 is a circuit wiring diagram of a power supply and a portable telephone according to the present invention.

DESCRIPTION OF THE PREFERRED EMBODIMENTS

Referring to the drawing in detail, a power supply 10 for a portable telephone 40 includes a battery pack of at least one battery cell. As shown, there are three battery cells 12, 14 and 16 connected in series, although any other number of cells within the scope of the present invention can be used. In a preferred embodiment, each battery cell is a 1.2 volt Nickel Cadmium (NiCd) or Nickel Mercury Hydride (NiMH) battery cell, although this specific voltage and type of cell is for illustrative purposes only and the present invention is not limited thereby.

The negative terminal of the first battery cell 12 is connected to a ground terminal 17, while the positive terminal of the last battery cell 16 is connected to the remainder of the circuitry, and outputs a voltage of 3.6 volts. It is preferred that the voltage values from battery cells 12, 14 and 16 are chosen so as to produce a voltage in the range of 3.0 to 4.2 volts which is unregulated. Such unregulated voltage is supplied to an output terminal 18 for use with circuits designed to operate over a voltage range 42.

The output voltage from battery cells 12, 14 and 16 is also supplied to a conventional boost/buck switcher 20 which can increase or decrease the voltage, for example, increase the voltage to 5.6 volts or any other suitable voltage, or decrease the voltage to any suitable voltage. Boost/buck switcher 20 is, for example, a conventional DC-to-DC converter. The output voltage from boost/buck switcher 20 is supplied through a first linear regulator 22 which regulates the voltage and provides a suitable voltage at a second output terminal 24, for use with a RF PA (radio frequency power amplifier) 44. For example, where the voltage from boost/buck switcher is 5.6 volts, linear regulator 22 may limit the voltage to 5.4 volts. The output voltage from boost/buck switcher 20 is also supplied through a second linear regulator 26 which regulates the voltage and provides another voltage, for example, of 5.0 volts, at a third output terminal 28 thereof, for use with a CODEC (coder/decoder) 46 and the like.

In addition, various filter circuitry (not shown) is preferably provided at output terminals 18, 24 and 28.

The above power supply 10 is preferably packaged in an EMI shielded case 30.

Thus, a power supply is provided for a portable telephone that is relatively lightweight, has a reduced size in comparison with conventional power supplies, and is relatively inexpensive to manufacture and use, while also having an EMI shielded case.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention as defined by the appended claims.

What is claimed is:

1. A power supply comprising:

at least one battery cell providing an unregulated output voltage;

a boost/buck switcher connected with said at least one battery cell for boosting/bucking said output voltage to a different level;

a regulator connected with said boost/buck switcher for regulating said boosted/bucked output voltage to produce a regulated voltage; and an EMI shield encasing said at least one battery cell, said boost/buck switcher, and said regulator to prevent emission of electromagnetic radiation due to switching of said boost/buck switcher.

2. A power supply according to claim 1, wherein said at least one battery cell includes a plurality of battery cells connected in series.

3. A power supply according to claim 2, wherein there are three said battery cells connected in series.

4. A power supply according to claim 1, wherein said output voltage is an unregulated voltage in the range of approximately 3.0 to 4.2 volts.

5. A power supply according to claim 1, further including an output terminal connected to said at least one battery cell and supplied with said output voltage.

6. A power supply according to claim 1, further including an output terminal connected with said regulator and supplied with the regulated voltage from said regulator.

7. A power supply according to claim 1, wherein said at least one battery cell includes a negative terminal connected to ground.

8. A power supply comprising:

at least one battery cell supplying an unregulated output voltage;

a boost/buck switcher connected with said at least one battery cell for boosting/bucking said output voltage to a different level;

a first regulator connected with said boost/buck switcher for regulating said boosted/bucked output voltage to produce a regulated voltage;

a second regulator connected with said boost/buck switcher for regulating said boosted/bucked output voltage to produce a second regulated voltage having a voltage value different from said first regulated voltage; and an EMI shield encasing said at least one battery cell, said boost/buck switcher, said first regulator and said second regulator to prevent emission of electromagnetic radiation due to switching of said boost/buck switcher.

9. A power supply according to claim 8, wherein said at least one battery cell includes a plurality of battery cells connected in series.

10. A power supply according to claim 9, wherein there are three said battery cells connected in series.

11. A power supply according to claim 8, wherein said output voltage is an unregulated voltage in the range of approximately 3.0 to 4.2 volts.

12. A power supply according to claim 8, further including:

a first output terminal connected to said at least one battery cell and supplied with said output voltage;

a second output terminal connected with said first regulator and supplied with the first regulated voltage from said first regulator; and a third output terminal connected with said second regulator and supplied with the second regulated voltage from said second regulator.

13. A power supply according to claim 12, wherein said output voltage is in the range of 3.0 to 4.2 volts, said first regulated voltage is approximately 5.4 volts and said second regulated voltage is approximately 5.0 volts.

14. A portable phone comprising:

an RF power amplifier;

at least one battery cell supplying an unregulated output voltage;

a boost/buck switcher connected with said at least one battery cell for boosting/bucking said unregulated output voltage to a boosted/bucked output voltage at a different level from that of said at least one battery cell;

a regulator connected to an output of said boost/buck switcher for regulating said boosted/bucked output voltage to produce a regulated voltage;

means for supplying said regulated voltage to said RF power amplifier; and an EMI shield enclosing said at least one battery cell, said boost/buck switcher, and said regulator to prevent emission of electromagnetic radiation due to switching of said boost/buck switcher.

15. The portable telephone according to claim 14 further comprising:

circuitry operable using unregulated voltage; and means for supplying said unregulated output voltage to said circuitry.

16. The portable telephone according to claim 15 further comprising:

circuitry requiring regulated voltage;

a second regulator connected to an output of said boost/buck switcher for regulating said boosted/bucked output voltage to produce a second regulated voltage; and means for supplying said second regulated output voltage to said circuitry requiring regulated voltage.

17. The portable telephone according to claim 14 further comprising:

circuitry requiring regulated voltage;

a second regulator connected to an output of said boost/buck switcher for regulating said boosted/bucked output voltage to produce a second regulated voltage; and means for supplying said second unregulated output voltage to said circuitry requiring regulated voltage.

18. The portable telephone according to claim 14 further comprising said EMI shield including a casing for enclosing said at least one battery cell, said boost/buck switcher, and said regulator to provide a shielded power supply assembly.

19. The portable telephone according to claim 16 further comprising said EMI shield including a casing for enclosing said at least one battery cell, said boost/buck switcher, and said regulator and said second regulator to provide a shielded power supply assembly.

20. The portable telephone according to claim 17 further comprising said EMI shield including a casing for enclosing said at least one battery cell, said boost/buck switcher, and said regulator and said second regulator to provide a shielded power supply assembly.

* * * * *